United States Patent [19]

Bucheister

[11] 4,368,451

[45] Jan. 11, 1983

[54] THERMOSTATIC SWITCH

[76] Inventor: Henry C. Bucheister, 89 Wheeler Ave., Cranston, R.I. 02905

[21] Appl. No.: 294,787

[22] Filed: Aug. 20, 1981

[51] Int. Cl.[3] ..... H01H 37/02

[52] U.S. Cl. ..... 337/380; 337/348; 337/358

[58] Field of Search ..... 337/3, 13, 56, 91, 348, 337/349, 354, 356, 358, 367, 380

[56] References Cited

U.S. PATENT DOCUMENTS

| | | | |
|---|---|---|---|
| 3,081,388 | 3/1963 | Cox | 337/349 X |
| 3,500,278 | 3/1970 | Them | 337/367 X |
| 4,039,991 | 8/1977 | Bucheister | 337/348 |

*Primary Examiner*—George Harris

*Attorney, Agent, or Firm*—Barlow & Barlow, Ltd.

[57] ABSTRACT

A thermally actuated switch located within a housing is disclosed, the switch having a bi-metallic element coupled thereto for the opening or closing of an electrical circuit. The switch is particularly characterized by a one-piece housing having a recess which provides a surface against which the bi-metallic heat responsive element engages and a surface against which a fixed electrical contact is held. Since there is a fixed relation of the element and the contact being a definite distance apart, and by the utilization of conductive contact members that self align within the housing, protrusions on the contact members egaging corresponding recesses in the housing, the actuating pin between the bi-metallic element and the contact may be of a uniform length thereby facilitating assembly of the switch.

4 Claims, 11 Drawing Figures

THERMOSTATIC SWITCH

BACKGROUND OF THE INVENTION

In thermally actuated switches it is important that the switches open circuits at precise temperature levels. In switch constructions known in the prior art, it has been necessary to calibrate each individual switch in order to insure that they will operate at the predetermined temperature level. To perform such calibrations, various length actuator pins are provided. It can be appreciated, therefore, that this is a time consuming operation which is labor intensive and, therefore, expensive. The construction of prior art switches in which the length must be selected are well exemplified, as for example, in the Vargas patent, U.S. Pat. No. 3,614,702 where the bi-metallic element is seated in one part of a two-part assembly, and the contact element is seated in another part of the two-part assembly. Accordingly, when the two parts are formed separately, the distance between the contact surface and the actuating bi-metallic element makes it necessary for the tailoring of each actuating pin. The adjustability, for example, as seen in the Mertler patent, U.S. Pat. No. 2,753,422 suggests the general problem. Further, it is often necessary to perform one hundred percent testing of thermally actuated switches. In the usual closed construction as exemplified by the Vargas patent above mentioned, the units that do not meet specifications must be discarded as no repair is possible. It is desirable, therefore, to reduce the number of faulty units.

SUMMARY OF THE INVENTION

According to the present invention, a thermally actuated switch is placed within a housing, the housing having one piece with slots therein through which the switch elements may be placed, the switch elements consisting of conductive contacts of sufficient dimension to extend through the walls of the housing, and to permit a connection to an external circuit. This one-piece housing also has surfaces against which the fixed contact member and the bi-metallic actuating element engages, so that the two surfaces mentioned are a fixed distance apart in one piece of material. The conductive switch or contact members are made in such a fashion that they have protrusions and recesses that mate one with the other in the housing to align the same in the housing without the utilization of any locating pins, fixturing or other means for maintaining positioning thereof within the housing.

The thermally actuated switch housing has a one-piece part receiving one of the electrical contact members, which engages a surface in the one-piece part of the housing to fix its relation, and also in a recess of this one-piece part there is loosely received a heat responsive element which recess has a surface against which the element may engage. The heat responsive element is coupled to the switch mechanism within the housing by means of a non-conductive pin. Since there is a fixed relation in the one-piece housing, the length of the non-conductive pin may be constant for a given specific temperature. The switch mechanism operates in a fashion whereby when the heat responsive element which is suitably chosen for a particular temperature distorts a sufficient amount, the non-conductive pin will engage one of the conductive contact members and change the electrical position thereof so as to at least open one circuit and in some instances possibly close another circuit indicating that a fault has occurred, or to perform another function. Because the heat responsive element is loosely received in the recess and is not loaded in any fashion, the snapping action of the element will always occur at a predetermined temperature. In some cases, the thermally actuated switch may be fitted with a manual reset mechanism which will unlock a device which holds the contacts apart once the heat responsive element has actuated the same, even though the thermal element returns to normal which type is commonly known as a trip free switch.

In all cases, the thermally actuated switch is of an open housing and separate cover. This allows testing of the switch with the cover in place but not irrevocably fastened. In this fashion, if the switch malfunctions, the cover may be removed, the heat responsive element and/or the non-conductive pin may be changed as necessary and the switch returned for testing. This is a substantial savings of material.

DESCRIPTION OF THE PREFERRED EMBODIMENTS

Figure 1:
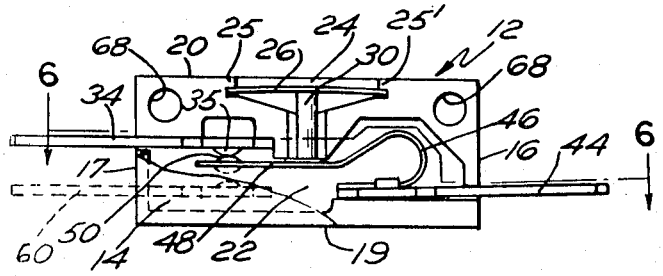
FIG. 1 is an elevational view of a thermostatic switch according to the present invention with a cover removed therefrom.
Figure 2:
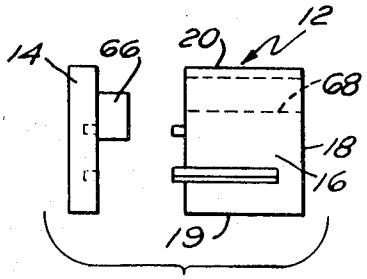
FIG. 2 is an end view showing the cover detached from the housing.
Figure 3:
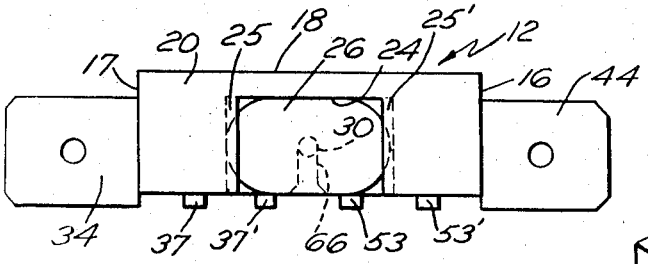
FIG. 3 is a top view of the switch of FIG. 1.

The thermostatic switch illustrated and described herein is of a type that includes a heat responsive thermally actuated element and is normally utilized where it is necessary to interrupt an electrical circuit in response to excessive heat.

Referring now to the drawing, and more particularly to FIGS. 1 through 6, the general arrangement of the thermostatic switch of the invention is illustrated and includes a one-piece housing 12 and a cover plate 14. The housing 12 and the cover plate 14 are preferably molded of a suitable material which exhibits electrical insulating and proper dielectric properties.

The housing 12 is molded in one piece with a bottom wall 19 and normal thereto and rising therefrom side walls defined as a pair of opposed end walls 16 and 17, a back wall 18, and a top wall 20, all of which define a central cavity 22 accessible from the front side opposite the back wall 18. In the top wall 20 there is formed a pocket 24 which has retainer lips 25, 25' or an upper retainer rim that retain, as can be seen in FIG. 1, a bi-metallic element 26 that is movable in response to temperature changes within the opening 24. These lips 25, 25' together with the floor of the pocket provide a bearing for the element when it is flexed in the opening 24. A bore 28 extends from the pocket 24 to the cavity 22 and receives an actuating pin 30 as seen in FIG. 1. In some cases the pocket may be inwardly of the exterior surface of the top wall to assist in sealing the mechanism.

Within the cavity 22 there is received a contact member 34 which has a flat surface engaging the flat surface 34*a* of cavity 22 with a contact button 35 at its inner portion. The contact member 34 is provided with protrusions 36, 36', 37, 37' (see FIG. 6) which are received in recesses 38, 38', 39, 39' (see FIGS. 4 and 5). The mating of the protrusions in the recesses is such that the contact member 34 which extends through the side walls 17, as via the slot 40, is positively and correctly located in the position in the cavity 22. The electrical contact 34 engages and seats against surface 34*b* of the housing 12 which because of the housing 12 being one piece, is a fixed relation to the rim or lips 25, 25', also, a part of this one-piece housing. This fixed relation makes it possible to select an actuating pin of a definite length without tailoring each length to pin to the particular assembly because of varying distances due to the surfaces 34*a* and 25, 25' being on different assembled parts which vary in manufacture. Similarly, received in the cavity 22 of the housing is a second contact member defined by a fixed leg 44 that extends through a slot 46 in the side wall 16, and secured to the fixed leg is a moveable contact arm that has a flexing portion 46 and a contact arm portion 48, which has a contact button 50 located near the end thereof. In similar fashion, it will be seen that the contact member 44 has protrusions 52, 52', 53, 53' which are located respectively in recess 54, 54' and 55, 55' in the cover. In addition, it will be appreciated that a second fixed contact member 60 may be provided that can pass through the side wall 17 with protrusions to be received in the same fashion, as for example, in the recesses 62 in the housing and 64 in the cover plate.

It will be seen that the contact member 48 is located in such a way that it is disposed in a normally closed contact position so that an electrical conductive path is made between the extending portions 34 and 44. It will also be apparent from the description as it has thus far proceeded that when the bi-metallic disc 26 is flexed in response to a temperature change, the actuating pin 30 will move the contact member 48 to break the contact between parts 34 and 44 and should a single pole double through condition be desired, contact could then be made between 44 and 60 as seen in FIG. 1.

Figure 4:
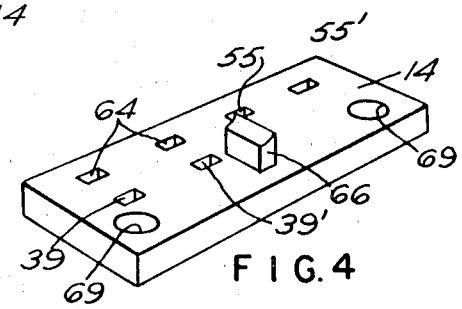
FIG. 4 is a perspective view of the cover for the housing.
Figure 5:
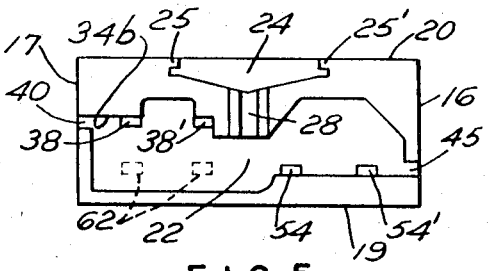
FIG. 5 is an elevational view of the housing with the parts removed.
Figure 6:
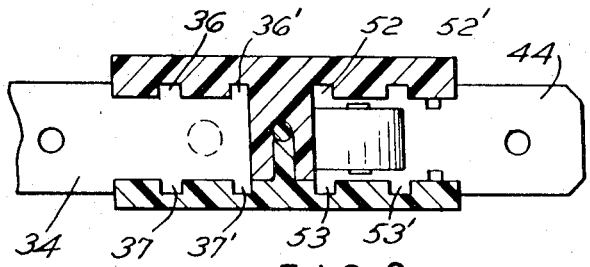
FIG. 6 is a sectional view on line 6—6 of FIG. 1.

For purposes of assembly the members will have been placed into the housing as seen in FIG. 1 and then the cover 14 will be placed in position, the cover being provided with a protruding member 66 which will enter the bore 28 and engage the actuating pin 30, and as will be seen in FIG. 4, the recesses will respectively engage all of the protrusions on the contact members. The device may then be secured together in any suitable fashion with fasteners that can pass through apertures 68 in the housing and 69 in the cover plate in manners well known to those skilled in the art.

Figure 7:
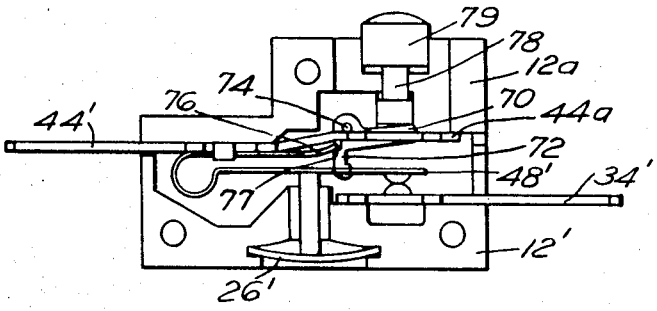
FIG. 7 is an elevational view of a thermostatic switch with a latching and reset mechanism in the normal operative position.
Figure 8:
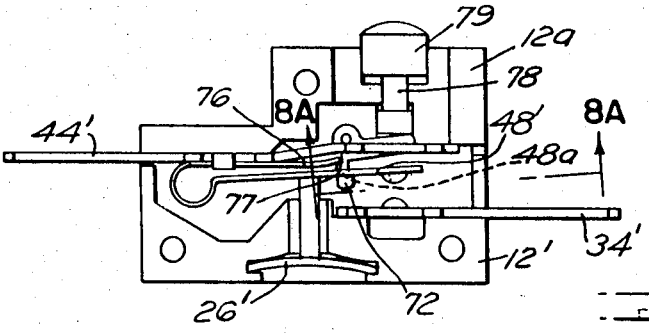
FIG. 8 is a similar view to FIG. 7 showing the mechanism operated indicating an overload.
Figure 8A:
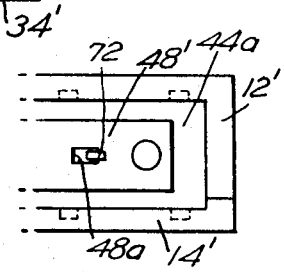
FIG. 8A is a view taken on lines 8A—8A of FIG. 8.

The thermostatic switch as embodied in the present invention can take a variety of forms and as seen in FIGS. 7 and 8, means have been shown for providing for the manual resetting of the contact members from an open position as seen in FIG. 8 to the closed position as seen in FIG. 7. In order to accomplish this resetting purpose, a locking device, generally in the form of an L-shaped arm having a first leg 70 and a second leg 72 with a hook end, is received in a slot of the extension 44*a* of the contact member 44', and is retained in position by means of a transverse pin 74. The arrangement is such that when the bi-metallic element 26' flexes to the position as seen in FIG. 8, and the contact arm 48' has moved upwardly, the latching arm 72 will engage within the slot 48*a* in the contact arm 48', (see FIG. 8) and maintain the contact in a raised non-conductive position. The action is enhanced by a spring leaf extension 76 which engages a ledge 77 on the arm 72 that constantly urges the hook to the right (as seen in the drawing) and into the latching position. Depressing the stem 78 will cause the head end thereof to engage the arm 70 of the latching member and urge the same against the spring pressure of the spring 76 to delatch the contact and allow the contact 48' to return provided the bi-metallic member 26' has returned to the normal position as seen in FIG. 7 of the drawings. In all other respects, the thermostatic switch is assembled in the same fashion as that described in connection with FIGS. 1 to 6, there being provided the protrusions on the contact members which engage recesses in the housing. In this case, the housing 12' has changed only slightly to have a raised boss portion 12*a* to receive the reset stem 78 and its enlarged finger engaging head 79.

Figure 9:
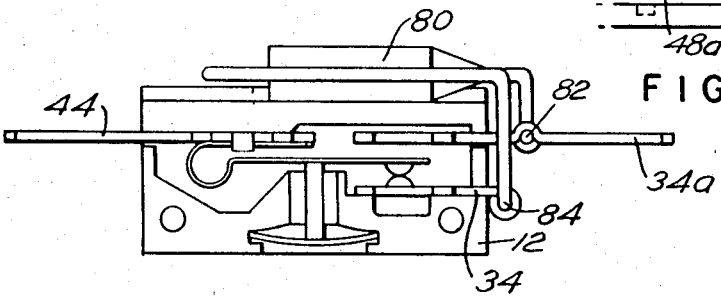
FIG. 9 is a sectional view of a form of thermostatic switch having a fusing device associated therewith.
Figure 10:
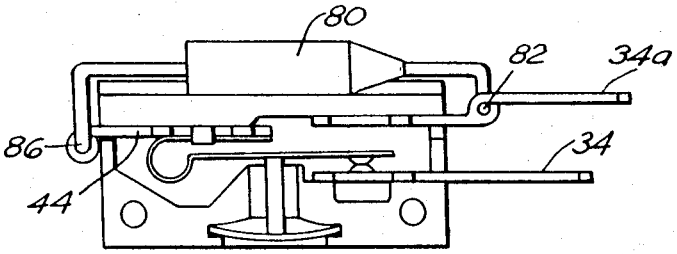
FIG. 10 is a view of another form of thermostatic switch with a fusing device, the connection leads coming out the same side of the body.

The thermostatic switch device lends itself to a variety of other configurations, as for example, those shown in FIGS. 9 and 10 where the housing 12 can be configured so as to have a built-in fuse 80 that is in a series circuit between the terminals that are connected to the circuit to be protected. For example, as seen in FIG. 9 the fuse 80 is connected to the terminal 34*a* as by welding as at 82 and connected to the terminal 34 as by welding at 84. In this fashion should an overload occur, then there is no electrical conductive path between the terminal 34*a* and the terminal 44. Similarly, as is seen in FIG. 10, should it be desired to have the terminals located on the same end of the switch housing, which facilitates use of the switch mounted on end on a circuit board, then the terminal 34*a* has one end of the fuse connected as in FIG. 9 at 82 while the other end is connected to a contact member 44 by welding as at 86 which achieves the same result. In all cases, the members are provided with protrusions which are received in recesses in the housing as has been described in connection with FIGS. 1 to 6, and likewise in the cover 14. The fuse will also protect against contacts that may weld together and to provide all features in one unit is convenient for the user.

I claim:

1. A thermally actuated switch comprising a one-piece molded housing member with a central cavity therein, said housing having walls lying in planes normal to each other to define a container with a back wall, upstanding side walls and an open face opposite the back wall, a first conductive contact member extending through at least one wall of said housing member and having an inner contact portion fixed with relation to the housing member, a second conductive member extending through a wall of said housing member and having a movable inner contact portion positioned to engage said fixed contact portion, said conductive members located in the cavity of said housing, a pocket opening in a side wall of said housing, a convex heat responsive element having its edges located in said pocket of said housing member, said pocket having an upper retaining lip defining a surface, and an opening to said central cavity, a non-electrical conductive actuator extending from said element to said second conductor member through said opening to move said second member in response to thermal changes of said convex element, said actuator having constant length by reason of the fixed distance between the lip and the first conductive member which is fixed in the same one-piece housing, and a cover to close the open portion of the cavity.

2. A switch as in claim 1 wherein said second conductive member is resiliently urged toward the first conductive member.

3. A switch as in claim 1 wherein said second conductive member is resiliently urged toward the first conductive member by a leaf spring means.

4. A switch as in claim 1 wherein an additional terminal is received in the housing, a fusible element, one end of the fusible element connected to the terminal, the other end connected to one conductive contact to be in series with the conductive members whereby electrical overload protection is provided when conductive members are maintained in electrical conductive state and malfunction.

* * * * *